US006486120B1

(12) United States Patent
Porta et al.

(10) Patent No.: US 6,486,120 B1
(45) Date of Patent: Nov. 26, 2002

(54) USE OF ALKOXYLATED SUGAR ESTERS IN LIQUID AQUEOUS SOFTENING COMPOSITIONS

(75) Inventors: Norba Porta, Vettweis-Glabch (DE); Hans Joachim Weissen, Kreuzau (DE)

(73) Assignee: Akzo Nobel N.V., Arnhem (NL)

( * ) Notice: Subject to any disclaimer, the term of this patent is extended or adjusted under 35 U.S.C. 154(b) by 204 days.

(21) Appl. No.: 09/979,618

(22) PCT Filed: Jul. 27, 2000

(86) PCT No.: PCT/EP00/04182

§ 371 (c)(1),
(2), (4) Date: Jan. 15, 2002

(87) PCT Pub. No.: WO00/66685

PCT Pub. Date: Nov. 9, 2000

(30) Foreign Application Priority Data

May 4, 1999 (EP) ..... 99201387

(51) Int. Cl.[7] ..... C11D 3/22
(52) U.S. Cl. ..... 510/515
(58) Field of Search ..... 510/471, 522, 510/527, 515; 536/116

(56) References Cited

U.S. PATENT DOCUMENTS

| | | | | | |
|---|---|---|---|---|---|
| 4,022,938 | A | | 5/1977 | Zaki et al. | 427/242 |
| 4,964,873 | A | * | 10/1990 | Duffin et al. | 8/137 |
| 4,982,467 | A | * | 1/1991 | Mizusawa et al. | 8/158 |
| 5,077,073 | A | * | 12/1991 | Ennis et al. | 426/531 |
| 5,344,811 | A | * | 9/1994 | Bunczk et al. | 504/192 |
| 5,376,287 | A | * | 12/1994 | Borcher, Sr. et al. | 252/8.8 |
| 5,773,409 | A | * | 6/1998 | Haq et al. | 510/521 |
| 6,051,541 | A | * | 4/2000 | Neuser et al. | 510/337 |

FOREIGN PATENT DOCUMENTS

| | | |
|---|---|---|
| BE | 827986 | 10/1975 |
| DE | 1277237 | 9/1968 |
| DE | 1934540 | 2/1971 |
| EP | 0 638 639 A1 | 2/1995 |
| EP | 0 882 798 A1 | 12/1998 |
| GB | 982078 | 2/1965 |
| GB | 1099777 | 1/1968 |
| WO | WO 98/16538 | 4/1998 |

OTHER PUBLICATIONS

International Search Report dated: Jul. 25, 2000 for Application No.: PCT/EP 00/04182.

1995 McCutcheon's vol. 1: Emulsifiers and Detergents, North American Edition, Manufacturing Confectioner Publishing Co., Glen Rock, NJ, pp. 93, 94 and 222..*

* cited by examiner

*Primary Examiner*—John Hardee
(74) *Attorney, Agent, or Firm*—Ralph J. Mancini

(57) ABSTRACT

The invention relates to specific aqueous compositions comprising alkoxylated sugar esters and their use as a softener. The alkoxylated sugar esters are characterised by a molar ratio of alkoxy units to hydroxy groups of the unmodified sugar from 1:4 to 3:1, a molar ratio of ester groups to hydroxy groups of the unmodified sugar from 0.25 to 0.70, and an HLB value below 8, preferably from 1–3. Preferably the alkoxylated sugar esters are combined with performance boosters selected from cationic and non-ionic compounds to increase their softening performance.

21 Claims, No Drawings

USE OF ALKOXYLATED SUGAR ESTERS IN LIQUID AQUEOUS SOFTENING COMPOSITIONS

The present invention relates to the use of sugar derivatives as a softener in liquid aqueous softener compositions and to liquid aqueous softening compositions comprising at least one sugar derivative and at least one performance booster.

Such use and compositions are known from WO 98/16538, where it is disclosed to use a combination of i) esterified or etherified sugar compounds comprising at least 2 or more ester or ether groups and containing at least 35% tri or higher esters and ii) a deposition aid, preferably a fabric softening quaternary ammonium compound.

However, improved aqueous sugar-based liquid softening compositions that combine excellent dispersion stability with a good softening performance are desired. Because of their non-ionic sugar ester structure, the ecotoxicity of these softening compounds is superior to the ecotoxicity of conventional (fabric) softeners. Preferably, softening compositions are developed which comprise a sugar moiety with inherent biodegradability and have a softening performance close to that of conventional (fabric) softeners and a dispersion stability superior to that of the compositions of WO 98/16538.

Extensive research on this well-developed subject has led to surprising results. More specifically, it was observed that when a specific type of sugar derivative is used, most of the known problems associated with current sugar-based (fabric) softeners could be overcome.

Accordingly, the current invention relates to the use of alkoxylated sugar esters with:

- a molar ratio of alkoxy groups in the alkoxylated sugar ester to hydroxy groups of the starting sugar from 1:4 to 3:1,
- a molar ratio of ester groups in the alkoxylated sugar ester to hydroxy groups of the sugar that was used from 0.25 to 0.70, and
- a HLB value below 8, in aqueous liquid softening compositions. Preferably, the alkoxylated sugar esters have a HLB value below 5, more preferably below 3.5, and most preferably below 3, while a preferred use is in one or more aqueous wash or rinse cycles.

In a second embodiment, the invention relates to aqueous liquid softening compositions comprising such alkoxylated sugar esters. Such compositions may be in the form of dispersions of said alkoxylated sugar esters, in the form of clear solutions of the alkoxylated sugar esters, or in a form wherein one or more of the alkoxylated sugar esters are partially dispersed and/or partially dissolved. The term aqueous means that the composition contains water. Usually, the liquid solvent/dispersing medium is predominantly water. However, in compositions according to the invention, more or less of the water may be replaced by other suitable solvents/diluents, such as alcohols, diols, and polyols. Preferably, such additional solvents/diluents are acceptable from an environmental point of view.

In respect of the HLB value of these compounds, the result of the HLB test as described below is decisive, because it has been observed that the results of calculus as used in the industry to predict the HLB value of a compound often are erroneous.

It is noted that conventional fabric softeners typically are based on hydrophobic quaternary ammonium compounds, mostly of the dialkyl ammonium type. For an indication of hydrophobic compounds, reference is made to E. Jungermann, ed., *Cationic Suffactants* (Marcel Dekker, 1970). The micelles formed by conventional (fabric) softening compounds in the washing water typically are adsorbed for 85 to 95% by the negatively charged textile fibres within 1 to 3 minutes. Such softeners are known to be unsuitable as detergents and may even act as soil fixatives. Hence they are often added to textiles after the washing step.

It is further noted that non-ionic compounds may also exhibit a softening performance, albeit one inferior to that of conventional dialkyl quaternary ammonium-based fabric softeners. WO 98/16538 discloses sugar esters, which are non-ionic compounds, with advantageous biodegradation properties when compared to conventional quaternary softeners. Until now, it has generally been believed that sugar-derived products typically have good biodegradation properties but insufficient dispersing properties and insufficient softening performance.

Furthermore, it is noted that, in contrast to the process to make typical sugar ester compounds, the process to make the alkoxylated sugar esters according to the invention does not necessarily make use of additional emulsifiers. Compared to the process to make conventional sugar ester compounds, the process according to the invention does not require the use of high-boiling, difficult to remove, a-protic solvents like DMSO and DMF, and again there is no need to use additional emulsifiers and/or catalysts. Hence, the alkoxylated sugar esters of the invention can be prepared in such a way as to make them less contaminated with emulsifiers and solvent than the conventional sugar ester compounds, with all associated advantages.

Alkoxylated sugar esters are known compounds. Their production is disclosed, for example, in GB 982,078, DE-AS-1 277 237, and DE-AS-1 934 540. In GB 982,078 the products are disclosed to be useful as plasticiser, foam stabiliser, emulsifier, dispersing agent, levelling agent, wetting agent, and as a raw material for plastics. According to DE-AS-1 277 237, they are compounds with optimal surface-active properties, while DE-AS-1 934 540 discloses that the products have good biodegradation properties and are useful as a raw material for laundry detergent compositions, in particular as an emulsifier, detergent, solubiliser and/or defoamer. Hence, a wide range of uses of these compounds has been proposed, including those in the laundry detergent field. The products, however, so far have only been promoted as a mere detergent, meaning that they are used to remove deposits from the surface of the textiles to be laundered, which is the purpose of most non-ionics in use today. Typically, detergents have a HLB value of 12–14 (see, for instance, H. E. Garrett, *Surface Active Chemicals* (Oxford: Pergamon Press, 1972), p. 56) and a corresponding high water solubility.

It is noted that conventional hydrophobic fabric softeners were often applied after the washing and rinsing steps of the laundry process, e.g., by spraying a solution of such conventional agents onto the fabric during or after drying, or by adding a substrate impregnated with such a conventional softener to the fabric during the drying step. Such impregnated substrates are also known as dryer sheets, since they are typically sheets of an impregnated pliable material that are added to the fabric when it is being dried. U.S. Pat. No. 5,376,287, for example, discloses the use of such dryer sheets wherein the heat of the drying cycle liberates the softeners for redistribution over the fabric being dried. Accordingly, the known products are highly ethoxylated and/or just slightly esterified with (hydrophobic) acids, or they are in the solid form, viz. in dryer sheet form, which is not according to the present invention.

Surprisingly, it has now been found that the aqueous alkoxylated sugar ester compositions according to the invention can be used as a softener in, inter alia, laundry applications. This means they can be added during a rinse and/or washing cycle. Typically, the aqueous compositions will contain 0.5 to 50, preferably 2.5 to 40, more preferably 5 to 30 per cent by weight of the total composition of said alkoxylated sugar esters.

Preferred alkoxylated sugar esters for use in said compositions have a HLB value of less than about 5, more preferably less than 3.5, and most preferably of 1 to 3. In order to obtain an optimum performance, they are preferably combined with a performance booster selected from the group consisting of cationic, anionic, amphoteric, and non-ionic surfactants, as known in the art. The group of performance boosters includes betaines, amines, water-soluble salts of amines, amine-oxides, and combinations thereof. Such boosters are typically present in an amount of 0 to 75, preferably 0.5 to 50 per cent by weight of the total composition according to the invention.

Preferred water-soluble salts of amines are salts of tertiary amines, more preferably those of tertiary amines with one $C_{16-18}$ hydrocarbyl group, and even more preferably the neutral salts thereof, with the amine being neutralised with organic or inorganic acids, such as citric acid or hydrochloric acid. Preferred amines, or salts thereof, that are suitable for use according to the invention include stearyl dimethyl amine (Armeen® 18 ex Akzo Nobel), tallow bis(2-hydroxyethyl) amine (Ethomeen® T/12 ex Akzo Nobel), and salts thereof. Preferred amine-oxides that can be used as a performance booster according to the invention are amine-oxides comprising one $C_{16-18}$ hydrocarbyl group, such as tallow bis(2-hydroxyethyl) amine-oxide (Aromox® T/12 ex Akzo Nobel). Preferred amphoterics include stearyl dimethyl betaine and tallow amphopolycarboxy glycinate (Ampholak® 7TX ex Akzo Nobel). Preferred anionic compounds include fatty alcohol sulfates, fatty alcohol ether sulfates, olefin sulfonates, and fatty acid salts (soaps). Typical examples of such compounds are sodium $C_{12-18}$ alkyl sulfate (Elfan® 280 D ex Akzo Nobel), sodium $C_{12-15}$ alkyl ether (2.5) sulfate (Elfan® NS 252 S ex Akzo Nobel), sodium $C_{14-16}$ olefin sulfonate (Elfan® OS 46 ex Akzo Nobel), and sodium stearate. However, preferably the performance booster is a cationic or non-ionic surfactant, as described below.

If the alkoxylated sugar esters are used together with one of the above-mentioned performance boosters, they are deposited, e.g., on a textile fabric, rather than remaining in the water phase and acting as a detergent. However, the dispersion of the alkoxylated sugar esters is more stable than that of corresponding non-alkoxylated sugar esters and therefore exhibits advantages with respect to storage stability and softening performance. Furthermore, the use during the washing/rinse cycle ensures a good distribution of the softener over the fabric, and the amount of softener can be easily controlled. It makes the use of dryer sheets superfluous.

Even more surprisingly, it has now been found that the improved dispersion behaviour of the alkoxylated sugar ester is accompanied by a good softening performance. Sometimes the softening performance of the ethoxylated sugar ester is even better than that of the sugar ester itself. This cannot be explained from theory, because theory predicts that alkoxylation with hydrophilic epoxides like ethylene oxide leads to a decrease of the softening performance due to the expected increase in HLB value. Furthermore, the excellent softening performance of combinations of alkoxylated sugar esters and one or more performance boosters is considered to be remarkable. Upon further investigation, it was observed that, contrary to theory, the alkoxylation of sugar esters leads to a decrease of the HLB value of the compounds. The most remarkable drop within the group of ethoxylated sugar esters was observed for compounds with a low degree of ethoxylation. Upon introduction of further ethylene oxide molecules, the HLB value again increases as expected, but often the HLB value will remain below the HLB value of the corresponding non-ethoxylated compound. Although this may explain the good softening performance of these compounds, it makes the improved dispersion stability the more surprising, because a more hydrophobic compound is expected to be less stable when dispersed in an aqueous phase.

The alkoxylated sugar esters to be used according to the invention can be prepared in well-known ways. For instance, they can be prepared by the process of GB 982,078, where an etherified sugar derivative is reacted with a fatty acid ester, optionally in the presence of a solvent, using sodium methylate or potassium carbonate as a catalyst at temperatures of 90–155° C. A similar process is described in DE-AS-1 934 540, where a sugar compound is first ethoxylated at 120° C. and subsequently esterified using a triglyceride at 100° C. and a potassium carbonate catalyst or a fatty acid at 180° C. with hydrochloric acid as the catalyst. However, they can also be prepared according to DE-AS-1 277 237, where a sugar compound is reacted in one step with ethylene oxide and a $C_{6-30}$ fatty acid at a temperature of 70–200° C. and a pressure of 1–50 atm in the presence of a $C_{1-18}$ alcohol. Furthermore, the process may consist of the steps where the sugar compound is first esterified and subsequently etherified. Optionally, a solvent is used in these processes and if the conditions are chosen properly, also an enzyme may be used to catalyse the esterification reaction as in, for instance, EP-A-0 882 798. It is preferred to produce the alkoxylated sugar esters according to the invention by first alkoxylating the sugar compound, followed by esterification of the intermediate. If the use of a solvent is desired during the alkoxylation step, e.g., to facilitate the contacting of the reactants and more efficient reaction heat removal, then it is preferred to use a solvent selected from the group consisting of water, glycerol, glycols, lower (preferably aliphatic) alcohols, and sorbitol. In a most preferred embodiment, a saturated solution of sugar in water is alkoxylated and subsequently, after removal of the water, esterified. It is to be noted that the term "esterification" as used herein comprises both direct esterification processes, e.g., by reaction of acid and alcohol, and transesterification processes, e.g., the reaction of an alcohol with a triglyceride.

If the alkoxylated sugar esters are to be used in softening compositions that do not comprise performance boosters, then it is preferred to use alkoxylated sugar esters with a HLB value of less than 5, more preferably of less than 3, and most preferably of less than 2, in order to obtain a good softening performance. Typically, the HLB value is greater than 1.

The sugar compounds that can be used according to the invention are mono- and disaccharides, reduction products thereof wherein the aldehyde or ketone group has been reduced to an alcohol moiety, dehydrated sugar derivatives, and mixtures of such compounds. Preferred sugar compounds have at least 4 hydroxy groups. Preferred monosaccharides are glucose, fructose, galactose, ribose, mannose, xylose, arabinose, and sorbose. Preferred disaccharides are maltose, sucrose, cellobiose, and lactose. Sucrose is the most preferred sugar compound used in the invention. Reduced saccharides include, but are not limited to, sorbitol, mannitol, xylitol, and erythritol. Sorbitol is a particularly preferred reduced sugar compound with 6 hydroxy groups. Of the less preferred dehydrated sugar derivatives, sorbitan is preferred, a compound with 4 hydroxy groups.

In order to obtain preferred alkoxylated sugar esters, the sugars are alkoxylated so that a molar ratio of alkoxy units in the final alkoxylated sugar ester to hydroxy groups of the original sugar molecule is from 1:4 to 2:1, more preferably from 1:4 to 3:2, and most preferably from 1:3 to 2:3. The alkoxylation reaction is preferably carried out by reacting epoxides with the sugar compound. Because alkoxylation of the various hydroxy groups of the starting sugar (or of the esterified sugar) will occur in a statistical fashion, as is known in the art, the above-mentioned ratio of alkoxy units to hydroxy groups is a ratio that may differ for each particular molecule but is on average within the specified range. Epoxides that can be used include, but are not limited to, ethylene oxide, propylene oxide, 1-butylene oxide, cis-2-butylene oxide, trans-2-butylene oxide, and combinations thereof. Preferred epoxides to make the alkoxylated sugar esters according to the invention are ethylene oxide, propylene oxide, and combinations thereof. If a combination of epoxides is used, this can be done by using a mixture of the respective epoxides during one and the same alkoxylation step, or by using different epoxides subsequently. The order in which the different epoxides are used is not restricted and the same epoxide can be used twice. By varying the degree of alkoxylation and/or the types and sequence of epoxides used, the skilled person will know how to adapt the HLB value of the resulting softener, if so desired.

The ester functions in the alkoxylated sugar esters of the invention typically are derived from saturated or unsaturated, linear or branched $C_{8-22}$ fatty acids, optionally substituted with, e.g., one or more hydroxy groups. Preferred fatty acids used in making the alkoxylated sugar esters of the invention include coconut, palm, palm kernel, soya, oleic, tallow, rapeseed, canola, behenic, eruca fatty acids, and mixtures thereof. Preferably a fatty acid mixture is used comprising at least 50 per cent by weight (%w/w) of $C_{16-18}$ fatty acids. The acids may be used as such in a conventional direct esterification process, but also derivatives can be used, such as the corresponding acid chlorides or (mixed) anhydrides. In transesterification reactions typically a fatty acid ester is used. In such transesterification reactions the methyl, ethyl, and/or glycerol esters of the acids are preferably used. Most preferred are mono-, di- and/or triglycerides of the acids. In order to arrive at softening compounds with the desired HLB value, the skilled person can vary the degree of esterification and the type of, optionally substituted, fatty acid in well-known ways. Nevertheless, the sugar compounds, or alkoxylated sugar compounds, are to be esterified with said acids such that the formed alkoxylated sugar ester has a molar ratio of ester groups to the OH groups of the original sugar compound from 0.25 to 0.70, meaning that 25–70% of all hydroxy groups, or etherified hydroxy groups, are esterified. Preferably, said ratio of ester to OH groups is from 0.30 to 0.65, white the most preferred ratio is from 0.35 to 0.60. Because such non-stoichiometric esterification reactions will not lead to one well-defined product, the specified ratio is the ratio as found on average in the resulting alkoxylated sugar ester.

The alkoxylated sugar esters with a HLB value of less than 8 and obtained as described above, when used in aqueous solutions, combine a good dispersion stability with a good softening performance, especially compared to the other known sugar derivatives. However, in a further embodiment of the invention, these alkoxylated sugar esters are combined with performance boosters to obtain a dispersion stability and a softening performance comparable with those of the best present-day softeners available.

The preferred performance boosters are selected from cationic surfactants and hydrophobic non-ionic compounds. The cationic surfactants can be of the conventional water-dispersible type, particularly quaternary dialkyl ammonium compounds, such as di(hydrogenated tallow) dimethyl ammonium chloride, methyl di(hydrogenated tallowamidoethyl) (2-hydroxyethyl) ammonium methylsulfate, 1-methyl 1-tallowamido-ethyl 2-tallow imidazolinium methylsulfate, and quaternary diesteralkyl ammonium salts, such as di(hydrogenated tallowoyloxyethyl) dimethyl ammonium chloride, 2,3-bis (hydrogenated tallowoyloxy)-propane trimethyl ammonium chloride, polyol ester quats as described in EP-A-0 638 639, and di(tallowoyloxyethyl) (2-hydroxyethyl) methyl ammonium methylsulfate, or of the type of water-soluble mono- and polyquats comprising one or more alkyl or alkenyl groups attached to the nitrogen either directly or by means of a functional group like oxyalkylene, polyoxyalkylene, and preferably a cleavable group like an ester or amide function. It is noted that the term water-dispersible compounds is meant to denote compounds that have a solubility in water of about 0.1%w/w or less at room temperature, while the term water-soluble compounds is used to refer to compounds with a solubility in water of greater than about 1%w/w at room temperature. Preferred are cationic surfactants that are water-soluble, of which typical examples include:

- monoalkyl quats like cocotrimethyl ammonium chloride, hexadecyl trimethyl ammonium bromide, hexadecyl trimethyl ammonium chloride, octadecyl trimethyl ammonium chloride, tallow trimethyl ammonium chloride, and tallow (hydroxyethyl) dimethyl ammonium chloride;
- monoester quats like $Me_3—N^+—CH_2CH_2OC(O)R\ X^-$, $Me_3—N^+—CH_2C(O)OR\ X^-$, $Me_2—N^+—(CH_2CH_2OH)CH_2CH_2OC(O)R\ X^-$, $Me_2—N^+—(CH_2C(O)OMe)CH_2CH_2O(O)CR\ X^-$, wherein R=$C_{8-22}$ fatty acid based and X=Cl, Br, $MeSO_4$, or acetate;
- amidoquats like $RCONHCH_2CH_2CH_2N^+—Me_3\ X^-$;
- water-soluble polyolester quats as described in EP-A-0 638 639, and
- water-soluble polyquats comprising at least one $C_{8-22}$ moiety with a preferred $N/C_{8-22}$ moiety ratio of 1:2 to 2:1.

More preferred water-soluble or self-emulsifying cationics contain $C_{16-18}$ groups. Most preferred are the $C_{16-18}$ monoalkyl and monoester quats. It was especially remarkable that water-soluble quaternary ammonium compounds, which as such exhibit just a minor or medium softening performance, have such a softening performance boosting effect.

Hydrophobic nonionics that can be used as performance boosters according to the invention include, but are not limited to, fatty alcohols like stearic alcohol, cetearyl alcohols or (hydrogenated) tallow alcohols, fatty acids like stearic acid or (hydrogenated) tallow fatty acids, and mono-, di- and/or triglycerides like coconut, palm, palm kernel, soya, oleic, tallow, rapeseed, canola, behenic and eruca oils, which optionally may be at least partly hydrogenated. $C_{16-18}$ alkyl groups-containing alcohols like hydrogenated tallow alcohol, hydrogenated tallow fatty acid, glycerol monostearate, and glycerol distearate are especially preferred. Other useful hydrophobic nonionics include alkoxylated, preferably ethoxylated, derivatives like $C_{8-22}$ fatty alcohol alkoxylates, $C_{8-22}$ fatty acid alkoxylates, $C_{8-22}$ fatty amide alkoxylates, alkoxylated $C_{8-22}$ glycerides, and mixtures thereof. Such hydrophobic nonionics typically have a HLB value of below 8, preferably below 5, in order to be effective.

The performance booster may be applied alone or in any combination with other known performance boosters. The weight ratio in which the (combination of) alkoxylated sugar esters and the (combination of) performance boosters are used typically ranges from 95:5 to 40:60%w/w. Preferably, the ratio between alkoxylated sugar esters and performance boosters ranges from 85:15 to 50:50 %w/w. If a combination of water-dispersible quats and hydrophobic non-ionic performance boosters is used according to the invention, then the preferred ratio of quat to nonionic is from 70:30 to 90:10%w/w. For combinations of water-soluble type of quats and hydrophobic non-ionic performance boosters the preferred ratio is from 0.1:99.9 to 50:50%w/w.

Even more preferred are combinations of alkoxylated sugar esters prepared by transesterification of glycerides, and still containing the residual mixture of non-ionic mono-, di-, and tri-glycerides, with one or more water-soluble cationic performance boosters. Preferably, such mixtures comprise 40–60%w/w of alkoxylated sugar ester, 40–60%w/w mono-, di- and/or tri-glycerides, and 40–60%w/w of water-soluble cationics, up to a total of 100%.

It is noted that the melting point of the alkoxylated sugar ester may have an influence on its performance as a softening agent. This feature was not optimised in the following examples. However, the skilled person will have no difficulty in varying, for example, the chain length of the fatty acid moiety of the alkoxylated sugar ester, the degree of alkoxylation, the types and ratio of epoxides used to alkoxylate the sugar (ester) or the type of sugar that is used as a starting material, in order to obtain products with optimum performance.

The compositions according to the invention can also contain one or more optional ingredients that do not impart the softening performance. Examples of optional ingredients that can be used are perfumes, perfume carriers, electrolytes, pH buffering agents, fluorescers, colourants, antifoaming agents, antiredeposition agents, anti-shrinking agents, anti-wrinkle agents, anti-spotting agents, anti-oxidants, anti-corrosion agents, antistatic agents, thickeners, enzymes, optical brighteners, opacifiers, germicides, fungicides, drape imparting agents, sunscreens, colour care agents, and ironing aids.

Other than for use in fabric softening, the alkoxylated sugar esters can also be used for conventional surface treatments. The alkoxylated sugar esters are, for instance, very suitable for use in personal care applications, such as hair and skin conditioners. For example, the use of the alkoxylated sugar esters according to the invention, especially in combination with water-soluble quaternary ammonium compounds, in hair rinsing compositions led to an efficient reduction of combing force and fly-away. The non-ionic nature of the alkoxylated sugar esters allows easy formulation of conditioning shampoos comprising them. Furthermore, the low impact on the environment (low ecotoxicitity) and resistance to long-term crystallisation make the alkoxylated sugar esters according to the invention particularly suitable for use in car-rinse applications. Finally, it is expected that the alkoxylated sugar esters according to the invention can be used with advantage in fluff and tissue softening, conveyor belt lubricants, mineral flotation, and manufacturing processes of organoclays.

The invention is further elucidated by the examples given below.

Experimental

The HLB value as given for the various compounds throughout this document is determined according to a practical test derived from the methods as published in "The HLB system, a time saving guide to emulsifier selection" by ICI Americas Inc, revised March 1980. Use is made of the principle as described therein that the HLB value of a mixture of emulsifiers is the weight averaged HLB value of each emulsifier. More particularly, Pioneer® 2076 paraffinic oil ex Hansen & Rosenthal is known to have a required HLB value of the emulsifier system of 10 in order to obtain the most stable oil in water (O/W) dispersion in demineralised water. In order to determine the HLB value of a test material with a HLB value below 10, it is combined with a known emulsifier with a HLB value greater than 10, in our case a polyoxyethylene-20 sorbitan monolaurate with HLB value 16.5 (supplied as Armotan® PML20 ex Akzo Nobel), in specific weight ratios. By determining which combination gives the best O/W dispersion, one can calculate the HLB value of the test material on the basis of the weight ratio. If so desired, subsequent further tests with more narrow mixing ratios can be performed. From these test the HLB value of the test material can be determined with an accuracy of about 0.25.

The dispersion stability of the softening compositions according to the invention is measured by dispersing a total amount of 5 grams of the (combination of) alkoxylated sugar esters and optional performance booster(s) in 95 grams of water, and transferring the dispersion to a graduated cylinder of 100 ml. After 1 and 24 hours the degree of phase separation is measured. The dispersion stability is expressed in terms of volume percentage of dispersed (W/O) phase.

The softening compositions according to the invention were evaluated for their softening performance in a fabric softening panel test. Pre-washed terry towels (using phosphate-free test detergent IEC-456, type A, from WFK-Institutes, Krefeld, Germany) were treated with the test material at a use level of typically 1.25 g per kg of fabric. The treated towels were line dried for 20 hours at 20° C. and 50% relative humidity, and cut into strips of 10 by 20 cm. A test panel of 24 people evaluated the softness in comparison with three standards (see below), and the data was statistically processed in accordance with standard DIN 10954.

References were selected as follows:

1) dimethyl-di(hydrogenated tallow) ammonium chloride (Arquad® 2HT ex Akzo Nobel), a conventional water-dispersible (fabric) softener,
2) 1 -methyl-2-tallowalkyl-3-tallowamido-ethyl imidazolinium methosulfate (Rewoquat® 7500 ex Witco), a conventional water-dispersible softener, and
3) untreated (no fabric softener used).

The performance of the tested fabric softener was ranked as follows:

+++ if equal to or better than Arquad 2HT
++(+) if significantly better than Rewoquat 7500
++ if equal to or better than Rewoquat 7500
+(+) if significantly better than untreated
+ if equal to or better than untreated
− if worse than untreated Significant meaning with a probability of at least 95% according to DIN 10954.

EXAMPLES 1–4 and Comparative Example A

A comparison was made between a sucrose tetrastearate (Ryoto Sugar Ester S-270) and corresponding ethoxylated sugar esters. The degree of ethoxylation of these ethoxylated sugar esters was varied, as was the way in which they were prepared.

In Example 1, 1 mole of sucrose (saturated solution in water) was etherified with 3 moles of ethylene oxide (EO) using 2%w/w KOH, based on the weight of the sucrose, as a catalyst. The resulting sucrose-3EO was subsequently transesterfied by adding 3 moles of hydrogenated tallow triglyceride per mole of sucrose-3EO and additional KOH up to a total of 0.8%w/w KOH, based on the total weight of the reaction mass, and heating to 140° C. in one hour under full water jet vacuum (20 mmHg) to remove all water and subsequent reaction at 140° C. for 6 hours. After cooling to 80° C., 1%w/w, based on the weight of the total reaction mass, of hydrogen peroxide was carefully added to bleach the product. Bleaching took place for 1 hour at 110° C. under full water jet vacuum, in which process all residual water was removed. The pale yellow liquid that resulted solidified as a white solid upon cooling to room temperature.

In Example 2, Example 1 was repeated, except that 1 mole of sucrose was etherified with 8 moles of EO using KOH as a catalyst.

In Example 3, Example 2 was repeated, except that the ethoxylated sucrose was esterified with methylstearate (4 moles per mole of the ethoxylated sucrose).

In Example 4, 1 mole of the sugar ester Ryoto S-270 was etherified with 8 moles of EO.

The dispersion stability and the softening performance were determined by using a dispersion of 3.2%w/w of the product of the examples in combination with 1.8%w/w of stearyl trimethyl ammonium chloride, a water-soluble monoalkylquat supplied as Arquad® 18 by Akzo Nobel.

The following results were obtained:

| Example | Product | EO/OH Molar ratio. | RCOO/OH Molar ratio. | HLB value | Dispersion stability (% after 24 hours) | Softening performance |
|---|---|---|---|---|---|---|
| 1 | sucrose-3EO-tetrastearate | 0.38 | 0.5 | 1.5 | 100 | +++ |
| 2 | sucrose-8EO-tetrastearate | 1 | 0.5 | 1.5 | 100 | ++ |
| 3 | sucrose 8EO-tetrastearate | 1 | 0.5 | 2.5 | 95 | +(+) |
| 4 | sucrose-8EO-tetrastearate | 1 | 0.5 | 2.0 | 97 | +(+) |
| A | Sucrose-tetrastearate | 0 | 0.5 | 3.5 | 85 | + |

The much superior performance and lower HLB value of Examples 1 and 2 is (partly) attributed to the mono-, di- and/or triglycerides and the ethoxylated derivatives thereof that were present in the ethoxylated sugar ester due to the way the ethoxylated sugar ester was made. These glycerides (and derivatives) act as a non-ionic performance booster.

EXAMPLES 5–10 and Comparative Example B–D

The influence of performance boosters was investigated in these examples. In Examples 5–7 the sucrose-3EO-tetrastearate of Example 1 was used, in Examples 8–10 use was made of the sucrose-8EO-tetrastearate of Example 2. In Comparative Examples B–D, the sucrose-tetrastearate of Comparative Example A was used. In the dispersion stability test 5%w/w of the ethoxylated sugar ester, or, if a combination with additional performance booster(s) is used, 3.2%w/w of the ethoxylated sugar ester and 1.8%w/w of the performance booster(s), is dispersed. The amount of ethoxylated sugar ester and performance booster as used in the softening performance test, per kg of fabric, is indicated in the table. HT-OH is hydrogenated tallow alcohol, supplied as Hydrenol® D by Henkel.

| Example | Amount of ethoxylated sugar ester (g/kg fabric) | Additional performance booster | Amount (g/kg fabric) | % Dispersed phase 1 hour | % Dispersed phase 24 hours | Softening performance |
|---|---|---|---|---|---|---|
| 5 | 1.25 | None | — | 100 | 98 | + |
| 6 | 0.81 | Arquad 18 | 0.44 | 100 | 100 | +++ |
| 7 | 0.81 | HT-OH | 0.44 | 100 | 95 | +(+) |
| 8 | 1.25 | none | — | 100 | 98 | – |
| 9 | 0.81 | Arquad 18 | 0.44 | 100 | 100 | ++ |
| 10 | 0.81 | HT-OH | 0.44 | 100 | 100 | + |
| B | 1.25 | none | — | <50 | <50 | – |
| C | 0.81 | Arquad 18 | 0.44 | 90 | <50 | + |
| D | 0.81 | HT-OH | 0.44 | 100 | 70 | – |

EXAMPLES 11–13 and Comparative Examples E–H

In Examples 11–13 the performance of the ethoxylated sugar ester of Example 1 and combinations thereof with additional performance boosters is compared with the use of just these performance boosters. Again, in the dispersion stability test 5%w/w of the ethoxylated sugar ester, or, if a combination with a performance booster is used, 3.2%w/w of the ethoxylated sugar ester and 1.8%w/w of the performance booster, is dispersed. The amount of ethoxylated sugar ester and performance booster as used in the softening performance test, per kg of fabric, is indicated in the table.

| Example | Amount of ethoxylated sugar ester (g/kg fabric) | Performance booster | Amount (g/kg fabric) | % Dispersed phase after 24 hours | Softening performance |
|---|---|---|---|---|---|
| 11 | 1.25 | None | — | 98 | + |
| 12 | 0.81 | Arquad 2HT | 0.44 | 100 | +(+) |
| 13 | 0.81 | Arquad 18 | 0.44 | 100 | +++ |
| E | None | Arquad 2HT | 1.25 | 100 | +++ |
| F | None | Arquad 18 | 1.25 | Solution | + |
| G | None | Arquad 2HT | 0.44 | 100 | – |
| H | None | Arquad 18 | 0.44 | Solution | – |

Hence, very good softening results are obtained if the ethoxylated sugar ester is combined with a water-soluble quaternary ammonium compound.

EXAMPLES 14–17

The performance of the ethoxylated sugar ester of Example 2 and combinations thereof with further performance boosters was determined. Again, in the dispersion stability test 3.2%w/w of the ethoxylated sugar ester and 1.8%w/w of the performance booster, is dispersed. The amount of ethoxylated sugar ester and performance booster as used in the softening performance test, per kg of fabric, is indicated in the table.

| Example | Amount of ethoxylated sugar ester (g/kg fabric) | Performance booster | Amount (g/kg fabric) | % Dispersed phase after 24 hours | Softening performance |
|---|---|---|---|---|---|
| 14 | 0.75 | Ethomeen T/12, HCl salt | 0.50 | 90 | ++ |
| 15 | 0.75 | Aromox T/12 | 0.50 | 100 | + |
| 16 | 0.50 | Elfan 280 D | 0.75 | 60 | +(+) |
| 17 | 0.75 | $C_{18}$ soap | 0.50 | 100 | +(+) |

$C_{18}$ soap = potassium stearate

The results show that various types of surfactants can be used as performance booster for the alkoxylated sugar ester.

EXAMPLE 18 and Comparative Example I

The combination of small amounts of the ethoxylated sugar ester of Example 2 with Arquad 2HT was evaluated and compared to the performance of just Arquad 2HT. In the dispersion stability test 3.2%w/w of the ethoxylated sugar ester and 1.8%w/w of the performance booster were dispersed, or 4.0%w/w of just performance booster. The amount of ethoxylated sugar ester and performance booster as used in the softening performance test, per kg of fabric, is indicated in the table.

| Example | Amount of ethoxylated sugar ester (g/kg fabric) | Performance booster | Amount (g/kg fabric) | % Dispersed phase after 24 hours | Softening performance |
|---|---|---|---|---|---|
| 18 | 0.35 | Arquad 2HT | 0.90 | 100 | +++ |
| I | none | Arquad 2HT | 0.90 | 100 | ++ |

The results show that a small amount of the alkoxylated sugar ester according to the invention can be used in combination with a conventional fabric softening compound to give an excellent softening performance.

EXAMPLE 19

The performance of a sorbitol derived ester, obtained by first ethoxylating sorbitol and subsequent reaction of the intermediate with hydrogenated tallow fat so that a product was obtained with a ratio EO/OH=0.5 and a ratio of ester/OH=0.5, was evaluated using Arquad 18 as the performance booster. In the dispersion stability test 3.2%w/w of the ethoxylated sorbitol ester and 1.8%w/w of the performance booster were dispersed. The amount of ethoxylated sugar ester and performance booster as used in the softening performance test, per kg of fabric, is indicated in the table.

| Example | Amount of ethoxylated sugar ester (g/kg fabric) | Performance booster | Amount (g/kg fabric) | % Dispersed phase after 24 hours | Softening performance |
|---|---|---|---|---|---|
| 19 | 0.81 | Arquad 18 | 0.44 | 100 | ++(+) |

This result shows that also alkoxylated sugar esters based on sorbitol can be used as a softener according to the invention.

What is claimed is:

1. An aqueous surface treating composition comprising one or more alkoxylated sugar esters with:

a molar ratio of alkoxy units in the alkoxylated sugar ester to hydroxy groups of the starting sugar molecule of, on average, from 1:4 to 3:1, a molar ratio of ester groups in the alkoxylated sugar ester to hydroxy groups of the starting sugar molecule of, on average, from 0.25 to 0.70, and a HLB value below 8.

2. The composition of claim 1 wherein the HLB value of the alkoxylated sugar ester is less than 5.

3. The composition of claim 1 wherein the molar ratio of alkoxy units of the alkoxylated sugar ester to hydroxy groups of the starting sugar is from 1:4 to 2:1.

4. The composition of claim 1 wherein the molar ratio of ester groups to hydroxy groups of the starting sugar is from 0.3 to 0.65.

5. The composition of claim 4 wherein the hydroxy groups of the original sugar compound, optionally after having been etherified, have been esterified by means of a saturated or unsaturated, linear or branched, optionally hydroxy group(s)-containing, $C_{8-22}$ fatty acid, or reactants capable of introducing such fatty acid ester groups.

6. The composition of claim 1 wherein the alkoxylated sugar ester is used in combination with one or more performance boosters in a ratio of between 95:5 and 40:60%w/w.

7. The composition of claim 6 wherein the performance booster is a water-soluble quaternary ammonium compound.

8. The composition of claim 6 wherein the performance booster is a non-ionic compound with a HLB value of below 8.

9. The composition of claim 8 wherein the non-ionic compound comprises one or more mono-, di- and/or triglycerides obtainable by the transesterification of an alkoxylated sugar compound and a triglyceride.

10. The composition of claim 1 wherein the HLB value of the alkoxylated sugar ester is in the range of from 1 to 3.

11. The composition of claim 1 wherein the molar ratio of alkoxy units of the alkoxylated sugar ester to hydroxy groups of the starting sugar is from 1:3 to 2:3.

12. The composition of claim 1 wherein the molar ratio of ester groups to hydroxy groups of the starting sugar is from 0.35 to 0.60.

13. Liquid aqueous softening composition comprising an alkoxylated sugar ester with:

a molar ratio of alkoxy units in the alkoxylated sugar ester to hydroxy groups of the starting sugar of, on average, from 1:4 to 3:1, a molar ratio of ester groups in the alkoxylated sugar ester to hydroxy groups of the starting sugar of, on average, from 0.25 to 0.70, and a HLB value below 8.

14. Softening composition according to claim 13 further comprising one or more performance boosters selected from anionic, cationic, amphoteric, and/or non-ionic surfactants.

15. Softening composition according to claim 14 further comprising one or more performance boosters selected from cationic and/or non-ionic surfactants.

16. Softening composition according to claim 15 comprising water-soluble quaternary ammonium compounds and/or non-ionic compounds.

a HLB value below 8.

17. Softening composition according to claim 14 wherein the ratio of alkoxylated sugar ester to performance booster (s) is from 95:5 to 40:60%w/w.

18. Softening composition of claim 14 comprising both water-dispersible cationic and non-ionic performance boosters in a ratio from 70:30 to 90:10%w/w.

19. Softening composition according to claim 14 comprising both water-soluble cationic and non-ionic performance boosters in a ratio from 0.1:99.9 to 70:30%w/w.

20. Softening composition according to claim 19 comprising 0.5–50%w/w of alkoxylated sugar ester, 0.5–50%w/w mono-, di- and/or triglycerides, and 0.0005–50%w/w of water-soluble cationics, up to a total of 100 percent by weight.

21. A liquid fabric softening composition comprising a softening effective amount of the alkoxylated sugar ester comprising a molar ratio of alkoxy units in the alkoxylated sugar ester to hydroxy groups of the starting sugar of, on average, from 1:4 to 3:1, a molar ratio of ester groups in the alkoxylated sugar ester to hydroxy groups of the starting sugar of, on average, from 0.25 to 0.70, and a HLB value below 8, and at least one performance booster selected from anionic surfactants, cationic surfactants, amphoteric surfactants, non-ionic surfactants and mixtures thereof.

* * * * *

UNITED STATES PATENT AND TRADEMARK OFFICE

CERTIFICATE OF CORRECTION

PATENT NO. : 6,486,120 B1
DATED : November 26, 2002
INVENTOR(S) : Porta et al.

It is certified that error appears in the above-identified patent and that said Letters Patent is hereby corrected as shown below:

Column 12,
Line 64, delete "a HLB value below 8."

Signed and Sealed this

Twenty-fourth Day of June, 2003

JAMES E. ROGAN
*Director of the United States Patent and Trademark Office*